US005779174A

United States Patent [19]

Starvaski et al.

[11] Patent Number: 5,779,174

[45] Date of Patent: Jul. 14, 1998

[54] MOUNTING ARRANGEMENT FOR LOOP DISTRIBUTOR IN A REFORMING CHAMBER

[75] Inventors: Raymond R. Starvaski; Frederick Ferrazza, both of Worcester, Mass.

[73] Assignee: Morgan Construction Company, Worcester, Mass.

[21] Appl. No.: 630,414

[22] Filed: Apr. 2, 1996

[51] Int. Cl.[6] ..... B21C 47/24; B65H 57/14; B21F 00/00

[52] U.S. Cl. ..... 242/363; 242/615.2; 140/2

[58] Field of Search ..... 242/615.2, 363, 242/615, 157 R, 361.2, 361.4; 140/2

[56] References Cited

U.S. PATENT DOCUMENTS 2,326,642 8/1943 Heiser ..... 242/615 X
5,273,231 12/1993 Starvaski ..... 242/363

*Primary Examiner*—John Q. Nguyen
*Attorney, Agent, or Firm*—Samuels, Gauthier, Stevens & Reppert

[57] ABSTRACT

A rolling mill reforming station has an annular chamber into which rings are dropped to acmmulate in coil form. A curved guide member projects downwardly from a rotating support into the path of ring descent. The guide member is readily removable from in addition to being adjustable in relation to the rotating support.

6 Claims, 2 Drawing Sheets

MOUNTING ARRANGEMENT FOR LOOP DISTRIBUTOR IN A REFORMING CHAMBER

BACKGROUND OF THE INVENTION

1. FIELD OF THE INVENTION

This invention relates generally to reforming chambers in wire rod mills, and is concerned in particular with an improvement in the mounting of the rotating curved guide members employed to distribute wire rod loops as they descend from the delivery end of a controlled cooling conveyor into the reforming chamber for accumulation into annular coils.

2. DESCRIPTION OF THE PRIOR ART

A known reforming chamber with a rotating curved guide member is depicted in U.S. Pat. No. 5,273,231 granted on Dec. 28, 1993. Experience has indicated that from time to time, the guide member must be removed, either when interchanging it for another differently shaped guide member to accommodate a change in the type or size of product being coiled, or to clear the way for removal of a jammed coil from the reforming chamber. In the latter case, vertical removal of the guide member is preferable, without any attendant radial or lateral displacement which might be blocked by the jammed coil. In all cases, rapid removal and interchangeability is highly desirable, preferably without the need to employ tools or to disassemble components. There is also a need for field adjustment of the guide member to properly locate it with respect to its support structure. Conventional guide member mounting arrangements are incapable of satisfying these objectives.

SUMMARY OF THE INVENTION

In accordance with the present invention, a horizontal rotatably driven ring surrounds the vertical path of loop descent into the reforming chamber. The curved guide member is connected to the ring by a bidirectionally engageable mounting arrangement which is adapted to accommodate vertical movement of the guide member onto and off the ring without attendant lateral or radial displacement of the guide member. The guide member can thus be cleared vertically without interference from an abutting jammed coil. The mounting arrangement allows for precise fitting of the guide member by simple adjustment of integrally associated threaded elements. The mounting arrangement also makes it possible to rapidly interchange one guide member for another, without employing tools and without dissembling either the guide member or adjacent associated components.

These and other features and advantages of the present invention will be described in greater detail with reference to the accompanying drawings wherein:

DETAILED DESCRIPTION OF THE ILLUSTRATED EMBODIMENTS

Figure 1:
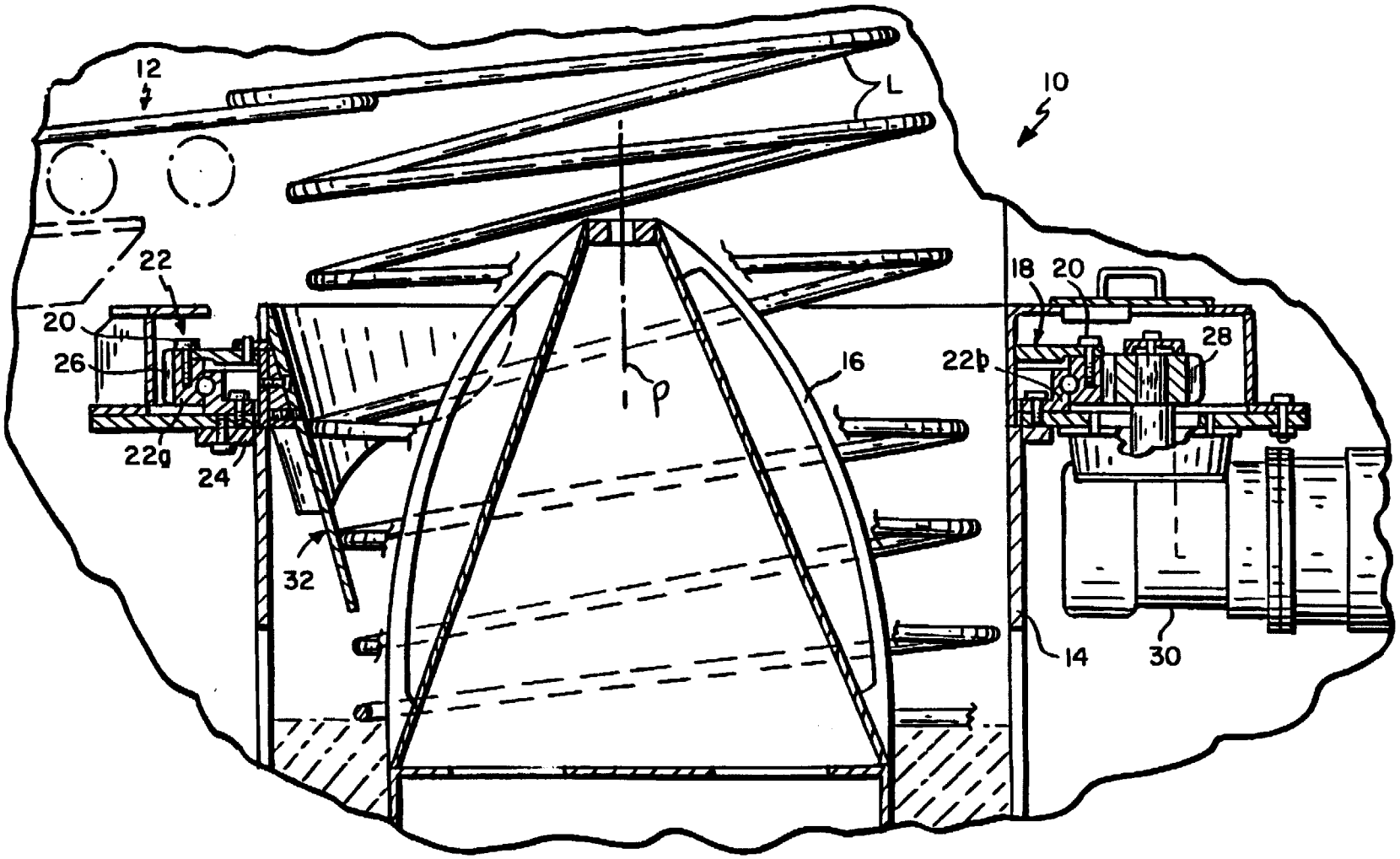
FIG. 1 is a vertical sectional view taken through the upper portion of a reforming chamber with a rotatable guide member mounted in accordance with the present invention.

Referring initially to FIG. 1, a coil reforming chamber is generally indicated at 10. The coil reforming chamber is positioned to receive a series of loops "L" descending along a vertical path "P" from the delivery end of a processing conveyor 12. Typically, the loops will be of steel rod which has been hot rolled and then deposited on the conveyor 12 for controlled cooling in an overlapping non-concentric pattern.

Figure 2:
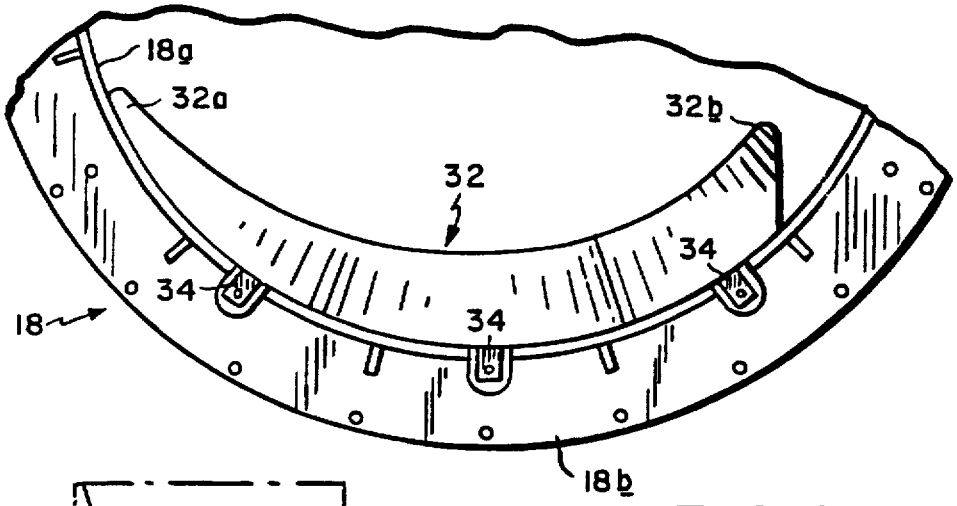
FIG. 2 is a partial plan view showing the ring member and curved guide member.

The reforming chamber 10 has an outer cylindrical wall 14 which cooperates with a centrally disposed mandrel 16 to gather the descending loops L into an annular coil. A horizontally disposed ring 18 surrounds the vertical path P. As can best be seen by further reference to FIGS. 2 and 4, the ring 18 includes a cylindrical vertical wall **18*a* and a radially outwardly extending annular ledge 18*b*. The ledge 18*b* is secured as at 20 to the outer race 22a of a circular bearing 22. The inner race 22*b* of the bearing 22 is fixed to a shelf 24 extending outwardly from the chamber wall 14**.

The outer bearing race **22*a* has gear teeth 26 which mesh with a pinion 28 driven by a motor 30. Thus, the motor serves as a means for rotatably driving the ring 18**.

A curved guide member 32 extends around a segment of the ring 18. The guide member has leading and trailing ends **32*a*, 32*b*, and protrudes inwardly from the ring 18 into the vertical path of loop descent into the reforming chamber. As can best be seen in FIG. 2, the extent of inward protrusion of the guide member 32 is greater at the trailing end 32*b* as compared to the leading end 32*a***.

The guide member 32 is provided with a plurality of outwardly protruding brackets 34 which are received in notches 36 in the cylindrical ring wall **18*a*, and which overlap the outer annular ledge 18*b*. Pins 38 are secured as by spot welding as at 40 to the brackets 34. The pins 38 protrude vertically downwardly into holes in the annular ledge 18*b***.

Figure 4:
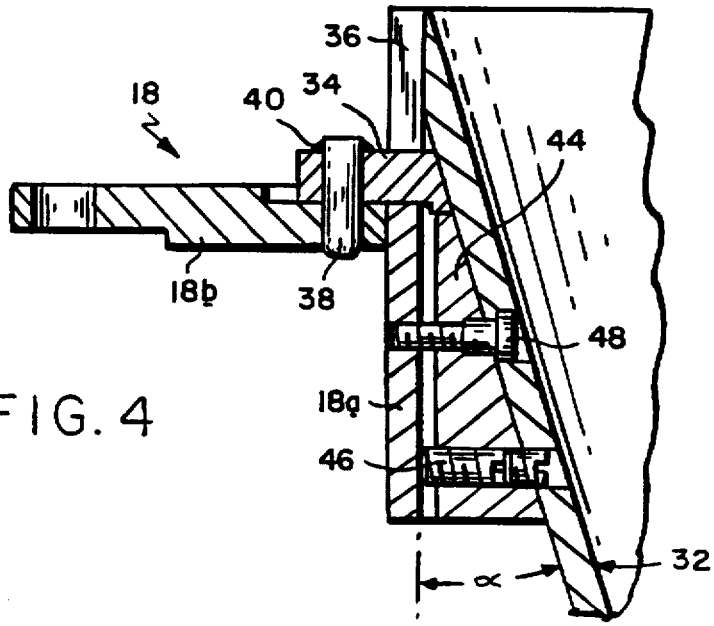
FIG. 4 is an enlargement of the a portion of the apparatus shown in FIG. 3.

As can best be seen in FIG. 4, the guide member 32 extends inwardly at an angle $\alpha$ with respect to the cylindrical ring wall **18*a* to thus define a wedge-shaped cavity therebetween. The guide member includes wedge-shaped filler pieces 44 arranged in the wedge-shaped cavity beneath the brackets 34. Set screws 46 are threaded through the guide member to bear against the cylindrical ring wall 18*a***.

It thus will be seen that the pins 38 and set screws 46 constitute a mounting means for the guide member 32 which is engageable bidirectionally with the ring 18. That is to say, the pins 38 are received in the annular ledge **18*b* in vertical directions parallel to the path P of loop descent, and the set screws 46 engage the ring wall 18*a*** radially with respect to the path P.

Figure 3:
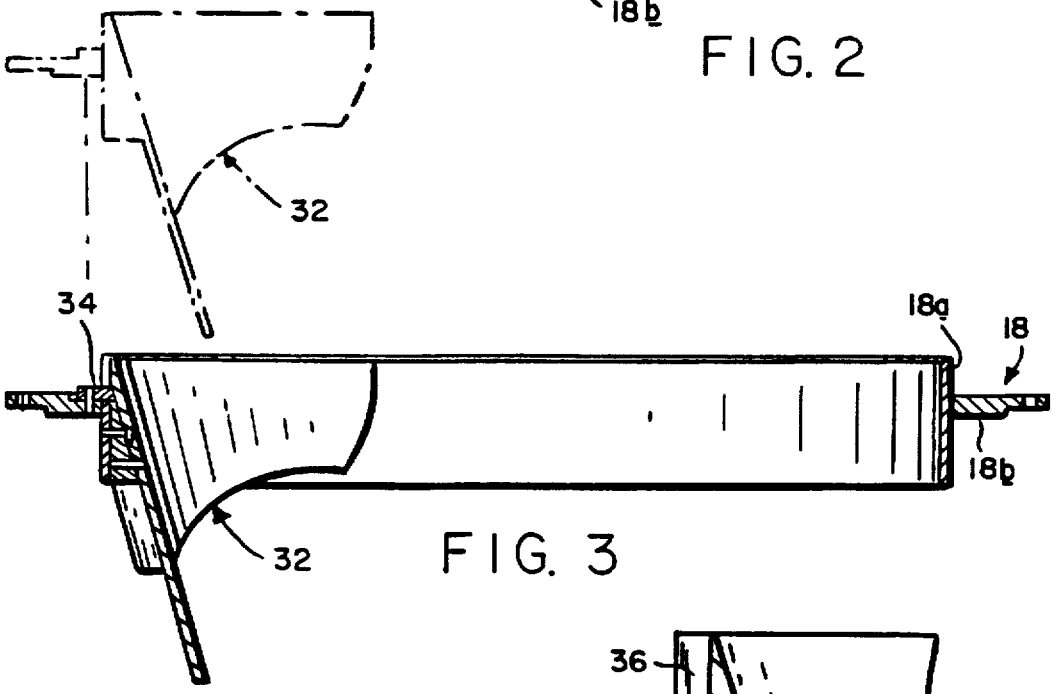
FIG. 3 is a cross-sectional view of the ring member and curved guide member.

As shown by the broken lines in FIG. 3, this mounting arrangement allows the guide member to be lifted vertically out of the reforming chamber, without the need to employ tools, and without having to dismantle either the guide member or any of its associated components. Thus, one guide member can be quickly exchanged for another to accommodate different product types and sizes. Also, in the event that a coil becomes jammed in the reforming chamber, the guide member can be slid past abutting loop segments as it is vertically extracted from the chamber.

The angular disposition of the guide member 32 can be varied by field adjustments to the set screws 46, thereby making it possible to achieve a precise positioning of the guide member with respect to its support structure. Optionally, additional threaded fasteners 48 may be employed to detachably secure the guide member 32 to the cylindrical ring wall **18*a***.

We claim:

1. In an apparatus for receiving a series of loops descending along a vertical path from the delivery end of a conveyor and for accumulating the thus received loops into an annular coil, a device for horizontally distributing the loops as they descend into the apparatus, said device comprising:

a) a ring surrounding said vertical path, said ring having a cylindical vertical wall and a radially outwardly extending horizontal ledge;

b) a curved guide member extending around a segment of said ring and having leading and trailing ends, said guide member protruding downward and angularly inwardly from said ring into said vertical path, with the extent of said inward protrusion being greater at said trailing end than at said leading end;

c) mounting means for connecting said guide member to said ring, said mounting means being engageable bidirectionally with said ring and being adapted to accommodate vertical movement of said guide member onto and off of said ring without attendant radial displacement of said guide member with respect to said ring, mounting means including adjustment means protruding radially outwardly from said guide member into engagement with said vertical wall for adjusting the angular position of said guide member relative to said ring; and d) means for rotatably driving said ring.

2. The device as claimed in claim 1 wherein said adjustment means comprises set screws threaded through said guide member to bear against said cylindrical wall.

3. The device as claimed in claim 1 wherein said mounting means further comprises screws releasably joining said guide member to said cylindrical wall.

4. The device as claimed in claim 1 wherein said guide member includes a plurality of brackets spaced along said ring and configured to overlap said annular ledge, said brackets being removably connected to said annular ledge by pin members extending vertically therebetween.

5. The device as claimed in claim 4 wherein said pin members are permanently joined to said brackets and are removably received in apertures in said ledge.

6. The device as claimed in claim 4 wherein said guide member protrudes angularly inwardly from said cylindrical wall to define a wedge shaped cavity therebetween, and wherein wedge shaped inserts are interposed between said cylindrical wall and said guide member at locations underlying said brackets.

* * * * *